United States Patent [19]

Stewart

[11] 4,337,943

[45] Jul. 6, 1982

[54] CUE BALL SHOOTING GUIDE

[76] Inventor: Gilbert Stewart, 10732 La Batista, Fountain Valley, Calif. 92708

[21] Appl. No.: 104,360

[22] Filed: Dec. 17, 1979

Related U.S. Application Data

[63] Continuation-in-part of Ser. No. 494,224, Oct. 6, 1978, abandoned.

[51] Int. Cl.[3] ..... A63D 15/00

[52] U.S. Cl. ..... 273/2; 141/311 R; 222/181; 401/195

[58] Field of Search ..... 273/2, 14, 17, 18, 23; 401/200, 186, 5, 195, 188; 33/9 A; 35/29 R; 141/311 R, 328, 340, 343; 222/181, 185

[56] References Cited

U.S. PATENT DOCUMENTS

| | | | |
|---|---|---|---|
| 1,312,320 | 8/1919 | Greiner | 222/185 |
| 2,780,392 | 2/1957 | Nonhof | 222/185 |
| 3,278,081 | 10/1966 | Carter | 222/185 |
| 3,306,498 | 2/1967 | Gonzalez | 222/185 |
| 3,843,120 | 10/1974 | Ricci | 273/2 |

*Primary Examiner*—Richard C. Pinkham
*Assistant Examiner*—T. Brown
*Attorney, Agent, or Firm*—K. H. Boswell; Edward D. O'Brian

[57] ABSTRACT

A guide used in teaching where to hit an object ball with a cue ball such that the object ball is deposited in a pocket of a pool table includes a marker which dispenses a small spot of a marker substance on the felt surface of the pool table. The marker substance leaves a spot on the felt which indicates the exact point at which the cue ball must be aimed in order to have the cue ball correctly strike the object ball to propel the object ball into the pocket. The marking substance is such that it will not leave a stain. The marker includes a reservoir for retaining a supply of the marking substance and an orifice which is capable of dispensing a small quantity of marking substance. The marker is supported above the surface of the felt by a support which has at least one surface capable of fitting next to the object ball and this surface is located precisely a radius distance away from the orifice on the marker. The support is positioned next to the object ball and the cue ball shooting guide is lined up with the pocket such that when the marker spot is dispensed from the marker, the spot is correctly placed one cue ball radius distance away from a line which is tangent to the object ball and passes through both the center of the object ball and the pocket.

2 Claims, 10 Drawing Figures

FIG. 1
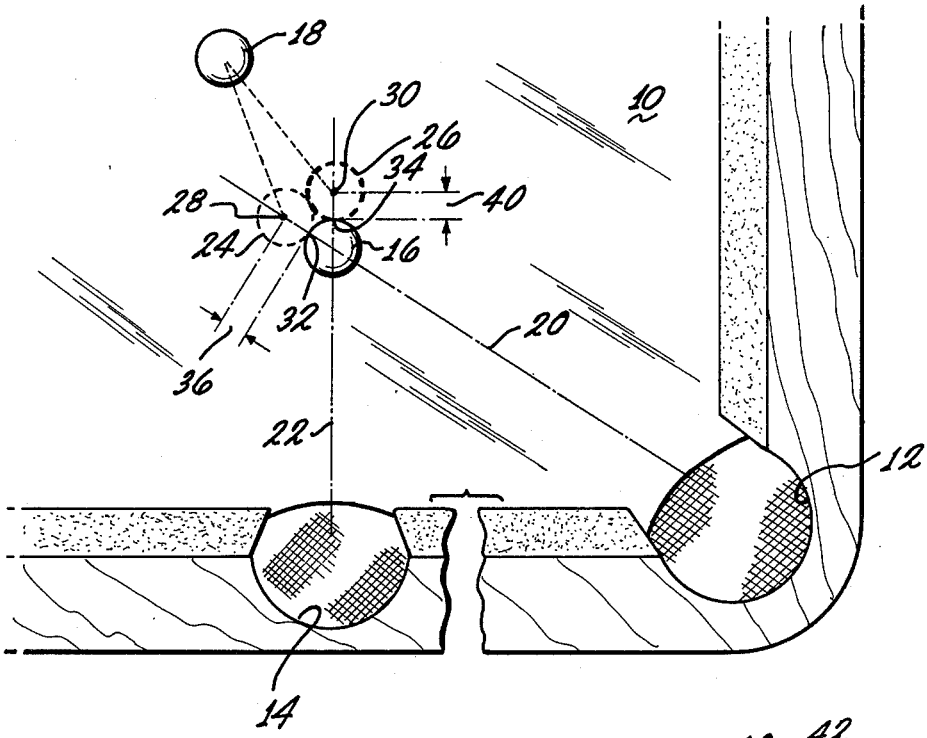
FIG. 2
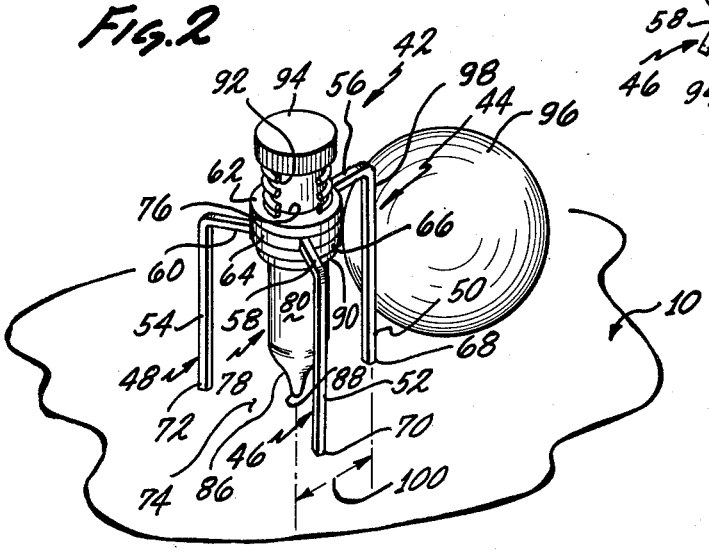
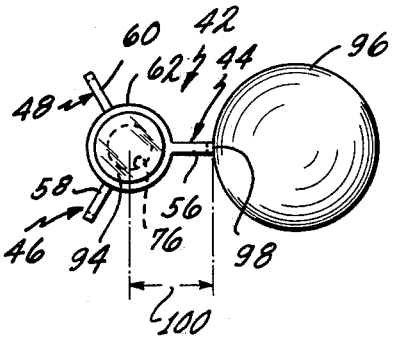
FIG. 3

CUE BALL SHOOTING GUIDE

This is a continuation-in-part of application Ser. No. 494,224 filed Oct. 6, 1978 (abandoned).

BACKGROUND OF THE INVENTION

This invention is directed to a shooting guide which assists a beginning pool player in correctly directing a cue ball toward an object ball such that the object ball is deposited into a pocket of a pool table.

In shooting pool it is the object to hit a cue ball with a cue propelling the cue ball toward an object ball such that after the collision of the cue ball and the object ball, the object ball is propelled into a pocket on the pool table. This process can be further complicated in what is called a combination shot wherein the cue ball strikes a first object ball and the first object ball is then used to propel a second object ball. As a pool player gets more sophisticated and obtains skill in playing pool, combination shots involving even more object balls can be made.

Because the balls are round, to the untrained player, when one ball hits another they seemingly move in an unpredictable manner. To gain proficiency in playing pool the unskilled player must play many games before he or she achieves the intuitive feeling of where to hit the cue ball against the object ball in order to propel the object ball in the direction desired. This process can be very frustrating and indeed can actually discourage a person from playing the game. To complicate matters, when the cue ball is struck with a cue, depending upon where the cue strikes the cue ball, the cue ball can in addition to being propelled forward, also be given a spinning motion. Thus if the cue strikes the cue ball at a point which is above the horizontal axis of the center of the cue ball, the cue ball will be given "top spin" which will cause the cue ball to spin in a direction away from the player. If the cue ball is struck below the horizontal axis the cue ball is given "draw" which will cause the cue ball to spin, in a relative way, back toward the player. If the cue ball is struck either to the right or left of the vertical axis of the center of the cue ball, the cue ball is given right or left "english" and is sent spinning like a top with either a right hand or left hand spin.

Certain laws of physics define the direction that a second spherical object will take when struck with a first spherical object. At the precise moment of impact the second sphere or ball will move off in a direction that follows the line which traverses through the center of both the first and second balls and additionally include the point wherein the first and second balls contact, i.e. the point where they are tangent to one another. This is of course neglecting any spin imparted to the second ball by the first ball, if the first ball is spinning. Thus while to an unskilled player there may seem to be no rhyme or reason as to the direction the object ball will travel when struck by a cue ball, there is in fact physical laws which govern this direction and which can be predicted.

BRIEF DESCRIPTION OF THE INVENTION

In view of the above it is a broad object of this invention to assist the unskilled player in determining exactly where (at which point) to shoot a cue ball in order that it strike an object ball such that an object ball is propelled in a direction desired by the shooter. In conjunction with this object it is a further object to provide a device which is capable of placing an erasable spot on the felt surface of a pool table at which the shooter may aim his cue ball in order that the object ball is moved in the desired direction. It is a further object to provide a device which is simple in construction and therefore economical to manufacture and as such is readily available to the amateur player. Additionally, it is an object of the invention to provide a marking spot which is temporary in nature and can be easily removed.

In view of these objects and others that will become evident upon reading the remainder of this specification, there is provided a cue ball shooting guide which will place a marking spot on the felt surface of a pool table which will assist a shooter in directing a cue ball such that the cue ball will strike an object ball in the correct place to propel the object ball in the direction desired which comprises: a marker means for dispensing the marker spot onto the felt surface; a support means for supporting said marker means above the felt surface and a locating means for correctly locating the marker means in a position such that the spot is placed in the correct location. The locater means positions the marker means such that the spot lies on a first line which is directed toward the center of the pocket or any other place to which the object ball is to be directed, and includes on this first line the tangential point of the object ball with the surface of the felt and further positions the spot one cue ball radius away from a second line which is perpendicular to and intersects with the first line and is also tangent to the object ball and lies on the side of the object ball which is opposite said pocket, i.e., the side to be struck by the cue ball.

BRIEF DESCRIPTION OF THE DRAWINGS

This invention can be illustrated by the drawing wherein:

FIG. 1 is a plan view of a pool table, an object ball, and two hypothetical placements of a cue ball;

FIG. 2 is an isometric view of a first embodiment of the invention;

FIG. 3 is a top plan view of the embodiment shown in FIG. 2;

Figure 4:
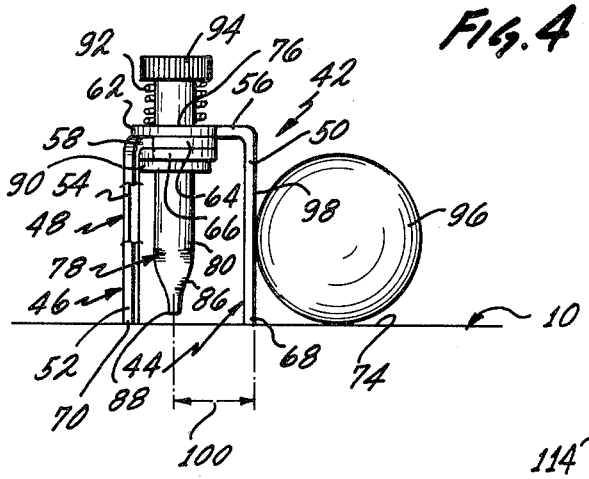
FIG. 4 is a side elevational view of the embodiment shown in FIGS. 2 and 3.

The invention illustrated in this specification and drawings utilizes certain operative concepts or principles which are set forth and defined in the appended claims forming a part of this specification. Those skilled in the art to which this invention pertains will realize that these concepts or principles could also be applied to differently appearing or differently describable embodiments from those embodiments herein described. For this reason the invention is not to be construed as being limited to the precise embodiments herein described but is to be construed in light of the claims.

DETAILED DESCRIPTION OF THE DRAWINGS

In FIG. 1 there is a illustrative view of a pool table 10 showing two pockets, corner pocket 12 and side pocket 14 which for the purposes of this illustration are not shown in the same spacial relationship they would have in a real pool table, that is the pool table is not shown to scale. An object ball 16 and a cue ball 18 are shown on the surface of the pool table 10. The cue ball 18 is struck with a cue (not shown) which is held essentially parallel to the surface of the table propelling cue ball 18 toward object ball 16.

In order to be deposited in corner pocket 12, object ball 16 must traverse path 20 shown as a phantom line. In order to be deposited in side pocket 14, object ball 16 must traverse path 22 also shown as a phantom line. To properly propel object ball 16 on path 20, cue ball 18 must strike object ball 16 when it is in location 24 shown in dotted line and conversely in order to propel object ball 16 into side pocket 14 cue ball 18 must be in location 26 shown as a heavier dotted line.

It can be seen in the figure that the centers 28 and 30 of the locations 24 and 26 respectively lie on the paths 20 and 22 respectively. The tangential point 32 between object ball 16 and location 24 also lies on path 20 and the tangential point 34 of object ball 16 and location 26 lies on path 22. As is evident from inspection of the figure the length of a location line 36 between tangential point 32 of object ball 16 and cue ball 18 and center 28 of position 24 is equal to the radius of cue ball 18. Likewise the length of location line 40 is also equal to the radius of cue ball 18.

In shooting strictly by eye a player, in order to correctly propel cue ball 18 against object ball 16 to "sink" (that is to deposit it into the pocket) object ball 16 in corner pocket 12, should hit the cue ball so that hopefully the cue ball would strike tangent point 32. In essence as a player gains experience he gets an intuitive feel as to where this tangential point is and is able to aim for this spot and thus sink the object ball 16 in the pocket for which he is aiming. A beginning player, however, has not yet developed this intuitive feel for proper placement of the cue ball 18 against the object ball 16. It can be seen by the figure, however, that if the player simply propelled the cue ball over center 28, the cue ball 18 would correctly strike the object ball 16, sinking it in the corner pocket 12 and likewise of the shooter propelled the cue ball 18 over center 30 the cue ball would correctly hit the object ball 16 to sink the object ball 16 in side pocket 14.

To facilitate correctly directing the cue ball 18 over centers 28 and 30 a small dot or spot could be placed at these centers to give the player a marker to aim at. Since the surface of the pool table is covered with felt a small drop of liquid will wet the felt and leave a dark spot or stain on the felt. This dark spot or stain can then serve as a marking spot for the shooter to aim at. That is, the shooter simply aims the cue ball so that the center of the cue ball crosses over this spot.

In FIGS. 2, 3 and 4 there is shown a first embodiment of the invention. A cue ball shooting guide 42 has three legs 44, 46 and 48. Each leg has a vertical segment 50, 52 and 54 respectively and a horizontal segment 56, 58 and 60 respectively which attach to the top end of the respective vertical segment 50, 52 and 54. On the other end of the horizontal segments 56, 58 and 60 are identical rings 62, 64 and 66. Each of the legs, for example leg 44, is formed such that segment 50, 56 and ring 62 form a continuous one piece construction. However, each of the vertical sections 50, 52 and 54 are of a different length. The lengths differ from each other by the thicknesses of the rings 62, 64 and 66 such that when the rings 62, 64 and 66 are stacked one upon the other the ends 68, 70 and 72 of vertical segment 50, 52 and 54 all lie in the same plane. As is shown in FIG. 4, this results in each of the rings 62, 64 and 66 lying in a horizontal plane coplaner with the top of the pool table 74.

A hole 76 is formed jointly by rings 62, 64 and 66. A marker 78 fits into this hole 76. Marker 78 is composed of a hollow cylinder 80 having screw threads 82 on upper end 84. Lower end 86 of hollow cylinder 80 tapers down to form a small orifice or capillary tip 88. Intermediate ends 84 and 86 is an annular flange 90 circumventing the outside of hollow cylinder 80. Hollow cylinder 80 is inserted into hole 86 by passing the upper end 84 through the rings 62, 64 and 66 until annular flange 90 rests against the bottom of ring 66. A spring 92 is inserted over upper end 84 of hollow cylinder 80 and a cap 94 is screwed onto threads 82. Cap 94 is dimensioned such that its diameter is greater than the diameter of spring 92. Spring 92 is chosen such that its height is slightly greater than the distance between upper ring 62 and the bottom of cap 94. This places spring 92 under a slight compression and as a consequence hollow cylinder 80 is urged upward until annular flange 90 is held against lower ring 66. The placement of annular flange 90 on cylinder 80 is such that when annular flange 90 is against ring 66, capillary tip 88 is held slightly above the surface of table 74.

The cue shooting guide 42 is positioned against object ball 96 by resting the outside surface 98 of one of the vertical segments 50, 52 or 54 (50 is illustrated in the figures) against the outside surface of object ball 96. As shown in FIG. 4 the outside surface 98 forms a tangential line which is tangent to the object ball 96 and is perpendicular to table surface 74. When in this position the distance 100 between the center of capillary tip 88 and the outside 98 of the appropriate vertical segment (or the previously described tangential line) is exactly equal to the radius of the cue ball. As is seen in FIG. 3 the horizontal segment 56 is then aligned such that its longitudinal axis is collinear with a sight line (such as paths 20 or 22 shown in FIG. 1) which passes through the center of object ball 96 and is directed toward an appropriate pocket.

Figure 5:
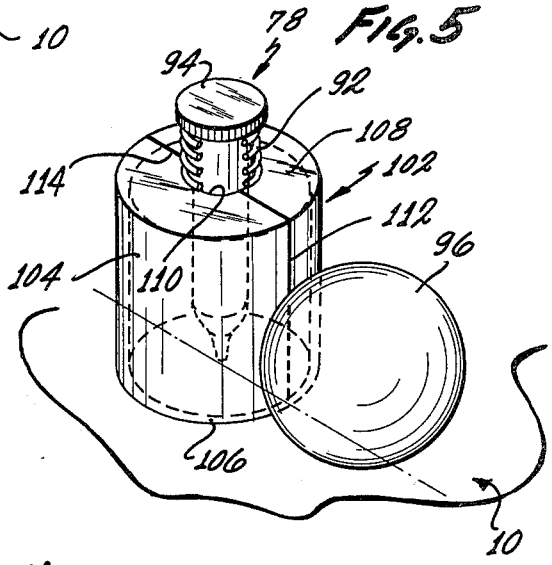
FIG. 5 is an isometric view of a second embodiment of the invention.

To place a marker spot on the felt, for the embodiments shown in FIGS. 2 through 4 as well as the embodiments shown in FIG. 5, after the shooting guide is lined up on proper position the shooter pushes the marker 78 in a downward direction by placing a finger on the cap 94 and going against the bias of spring 92 until the capillary tip 88 comes in contact with the felt on top of the pool table. When the capillary tip 88 contacts the felt a small amount of liquid diffuses into the felt leaving a spot or liquid stain. Pressure against cap 94 is then released and the spring 92 returns the marker 78 to its resting position wherein the annular flange 90 rests against either ring 66 or the bottom of top 108 (hereinafter described) and the guide is removed.

For convenience in storing, the cue shooting guide 42, legs 44, 46 and 48 can be swiveled toward one side forming a compact group. Additionally if the object ball 16 is in a cluster of other balls, two legs, such as 46 and 48, which are not placed against the object ball 16 can be rotated about the center of the axis of marker 78 such that they will avoid hitting any other object ball which might be in the area of object ball 16.

In FIG. 5 there is shown a second alternate embodiment of the invention. This embodiment utilizes a marker 78 identical to that previously described therefore references to this marker and all parts of it will be made using the numerals previously assigned to the parts of the marker 78. The cue ball shooting guide 102 shown in FIG. 5 has a cylindrical support 104 having an open bottom 106 and a top 108 having a hole 110 through the center thereof. The marker 78 fits in hole 110 in a manner essentially as described for fitting marker 78 in hole 76. A spring 92 fits against cap 94 and biases marker 78 in an upward direction until annular flange 90 presses against the bottom side of top 108. The cylindrical support 104 is dimensioned such that when annular flange 90 is against the bottom of top 108, capillary tip 88 will be slightly raised from any surface on which the cue ball shooting guide 102 is set. As an aid in using the shooting guide 102 the cylindrical support 104 has a vertical line 112 painted on its surface and a horizontal line 114 which is perpendicular to line 112 painted across the top 108. The shooting guide 102 is placed against an object ball 96 such that the vertical line 112 rests against the surface of the object ball 96. The horizontal line 114 is lined up such that an imaginary line projecting from the end of horizontal line 114 passes through the center of object ball 96 and then towards the center of the pocket to which it is desired to sink object ball 96. The spot is then marked as previously described.

To facilitate seeing the marking spot, cylinder support 104 can be formed of a clear material such as a clear plastic. Normally all of the components of the shooting guides 42 and 102 will be formed of a suitable thermoplastics using injection mold techniques. The spring of course is normally a metal spring. The shooting guides 42 and 102 could alternately be formed of a metal, such as aluminum, if it is required or contemplated that these guides will be used in commercial situations wherein they would be subject to heavy use or abuse.

Figure 7:
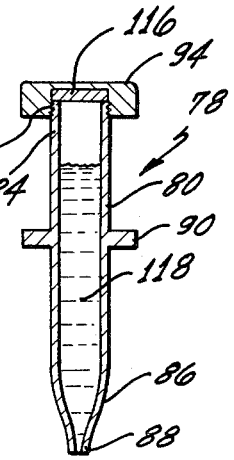
FIG. 7 is a side elevational view in section of a portion of the invention shown in FIG. 2.

FIG. 7 shows a side view in section of the marker 78. Inside of cap 94 is a gasket 116 which seals against the top of hollow cylinder 80 forming a closed chamber and prevents liquid 118 from draining through capillary tip 88. When the capillary tip 88 is placed against a felt surface a small portion of liquid 118 will drain onto that surface and when the capillary tip 88 is lifted from the surface a bubble of air will rise up through capillary tip 88, through liquid 118 and equalize the pressure inside of marker 78.

Figure 8:
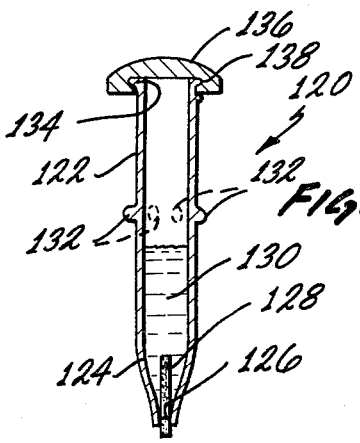
FIG. 8 is a side elevation in section of an alternate embodiment of the portion of the invention shown in FIG. 7.

In FIG. 8 there is shown an alternate embodiment of the marker 120. A hollow cylinder 122 substantially similar to cylinder 80 has a tapered end 124 having a small orifice 126 therein. Inserted in this orifice 126 is a short segment of a wick 128 which projects a small distance from the tip of end 124. A liquid 130 wets the wick 128 and when the wick 128 is placed against the felt surface of a table liquid 130 is transferred from the wick 128 to the felt surface. In place of annular flange 90, marker 120 has a series of fingers 132 extending out horizontally from the vertical axis of the marker. The top of hollow cylinder 122 culminates in a lip 134. A cap 136 formed of a plastic or rubbery material has a groove 138 within its interior. When cap 136 is force fitted over the top of hollow cylinder 122, lip 134 fits into and seals within groove 138. Any one of the three features, i.e., the cap, the fingers or the wick, described in the embodiment of FIG. 8 which differ from those shown in the embodiment of FIG. 7 can be interchanged with the screw cap, the flange or the capillary tip described in the embodiment of FIG. 7.

Figure 6:
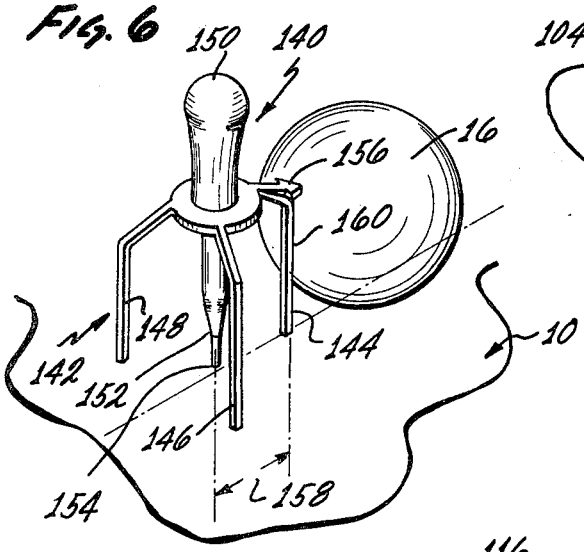
FIG. 6 is an isometric view of a third embodiment of the invention.

FIG. 6 shows a third alternate embodiment of the cue ball shooting guide 140. A tripod stand 142 having three legs 144, 146 and 148 support a fluid reservoir bulb 150. The bulb 150 is connected to a dispensing tip 152 whose end 154 is slightly elevated from the plane at which the ends of legs 144, 146 and 148 rest. A directional arrow 156 extends over leg 144. In use, leg 144 is placed tangent to an object ball 16 and the cue ball shooting guide 140 is moved about this tangent point until arrow 156 points in the direction of the pocket wherein it is desired to sink object ball 16. A small drop of fluid is squeezed out of bulb 150 placing a marker on the surface of the felt on the top of the pool table. The distance 158 from the dispensing tip 152 to the outside edge 160 of leg 144 is exactly equal to the radius of the cue ball which results in correct placement of the marking spot.

For all of the above embodiments shown, normally water will be used as the marking fluid since it is readily available and will dry from the surface of the felt in a reasonable time. Other fluids, such as alcohol, could also be used. If alcohol is used the marking spot on the felt would, of course, disappear faster than a water marking spot since alcohol would evaporate faster than water.

Depending upon the size of the pool table, pool balls of different sizes are available, e.g., a $\frac{1}{2}$ or $\frac{3}{4}$ sized table would, of course, utilize smaller sized pool balls. For this reason the cue ball shooting guide is sized accordingly to the size of the balls used. It is normally considered that in any one location, only one size ball would be in use and because the cue ball shooting guide can be manufactured for a very nominal cost, the shooting guide would be of a specific size. Alternately, however, an adjustable shooting guide having at least one leg which is adjustable so that the distance between the center of the marker and the edge of the leg is variable, could be constructed.

The above described embodiments disclose using a liquid marking system; an alternate marking system which utilizes a solid marker such as chalk can also be used.

Figure 9:
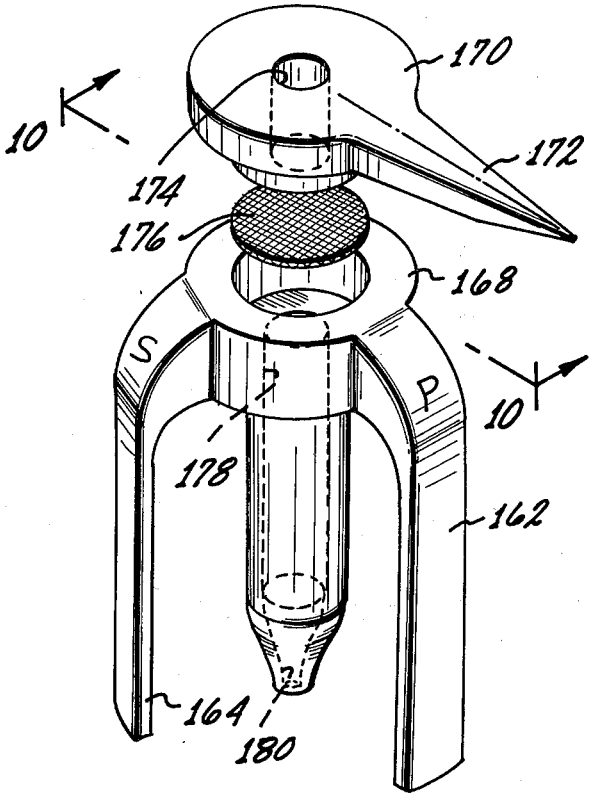
FIG. 9 is an isometric view of another alternate embodiment of the invention.
Figure 10:
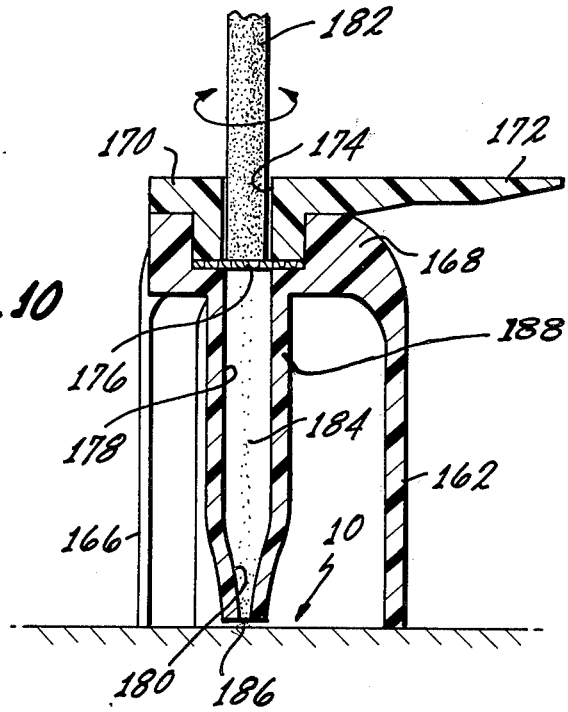
FIG. 10 is a side elevation in section about the line 10—10 of FIG. 9.

In the fourth alternate embodiment shown in FIGS. 9 and 10 a marking system utilizing chalk is described. A support ring 168 has three legs 162, 164 and 166 attached thereto. Fitting within the support ring 168 is a screen or grid 176. A cap 170 fits onto the support ring 168 such that the screen or grid 176 is fixedly held within the interior of the support ring 168. The cap 170 has a hole 174 sized to accept a piece of common chalk 182. Extending downwardly from the support ring 168 is a tube 188 having a hollow interior 178. The interior tapers down to a fine point 180. When the piece of chalk 182 is twisted using a downward motion on screen 176 small bits of chalk dust 186 are flaked off and are deposited through the fine point 180 as a fine chalk spot.

Integrally formed with the cap 170 is a pointer 172 which is lined up toward the center of the ball to be struck as previously described. In the embodiment shown in FIGS. 9 and 10 leg 166 is shown with an indicia P thereon and leg 164 with an indicia S thereon. The distance between the leg marked with the P and the center of the fine point 180 is equal to the radius of a common pool ball. The distance between the leg 164 marked with the S and the center of the fine point 180 is equal to the radius of a common snooker ball. Thus, if one is using the marking apparatus in a pool game leg 162 would be used and the pointer 170 would be located over it and coversely if a snooker game is being played leg 164 would be used and the pointer 172 would be twisted to be located over it.

While screen 176 is shown as a separate part it could be integrally formed with the support ring 168 using molding techniques. However, it is considered advantageous from an economic point of view to simply use a small circular section of screen for this purpose. Once the chalk dust 186 is deposited on the surface of the pool table 10 it is easily vacuumed or brushed off after the player has taken his shot.

I claim:

1. A cue ball shooting guide for placing a marking spot on the felt surface of a pool table to indicate the line of travel over the felt surface that a cue ball must take to correctly strike an object ball to propel said object ball towards a pocket in said pool table which comprises:

a dispensing member including an essentially vertical hollow tubular member having open ends, the lower of said ends forming a small opening in the bottom of said tubular member;

said dispensing member including an abrasive member located in association with said hollow tubular member, said abrasive member including a surface capable of breaking a piece of chalk into chalk dust when said piece of chalk is moved over the surface of said abrasive member;

support means supporting said dispensing member above said felt surface;

locating means for locating said dispensing member in a position over a point on said felt surface where said marking spot is to be placed, said point lying on a first line which is directed toward the center of said pocket and includes on said first line the tangential point of the object ball with the surface of said felt, said point being one cue ball radius distance away from a second line which is perpendicular to an intersects with said first line and is tangent to the side of said object ball opposite said pocket;

said locating means locating said dispensing member over said point such that when a portion of said piece of chalk is abraded on said abrasive member said chalk dust formed passes into said tubular member through the upper ends of said tubular member and exits out said tubular member through said small opening at the lower of the ends of said tubular member and is deposited onto said felt surface at said point forming said marker spot on said felt surface at said point.

2. The cue ball shooting guide of claim 1 wherein: said support means comprises a support member having three supporting legs forming a triangular support capable of maintaining said dispensing member in a position over said point on said felt surface.

* * * * *